US007527902B2

(12) United States Patent
Wu et al.

(10) Patent No.: US 7,527,902 B2
(45) **Date of Patent: *May 5, 2009**

(54) PHOTORECEPTOR LAYER HAVING SOLID AND LIQUID LUBRICANTS

(75) Inventors: Jin Wu, Webster, NY (US); Geoffrey M T. Foley, Fairport, NY (US); Jodie L. Watson, Ontario, NY (US); Liang-Bih Lin, Rochester, NY (US); Edward C. Savage, Webster, NY (US); Robert P. Altavela, Webster, NY (US); Linda Ferrarese, Rochester, NY (US); Marc J. Livecchi, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 502 days.

This patent is subject to a terminal disclaimer.

(21) Appl. No.: 11/193,541

(22) Filed: Jul. 28, 2005

(65) Prior Publication Data

US 2007/0026330 A1 Feb. 1, 2007

(51) Int. Cl.
*G03G 15/02* (2006.01)

(52) U.S. Cl. ..... 430/58.05; 430/58.35; 430/66; 399/159

(58) Field of Classification Search ..... 430/58.05, 430/66, 58.35; 399/159
See application file for complete search history.

(56) References Cited

U.S. PATENT DOCUMENTS 5,204,202 A * 4/1993 Ishikawa et al. ..... 430/66
5,272,029 A * 12/1993 Sakai et al. ..... 430/59.6
6,521,386 B1 * 2/2003 Sakon et al. ..... 430/58.15

* cited by examiner

*Primary Examiner*—Mark A Chapman
(74) *Attorney, Agent, or Firm*—Pillsbury Winthrop Shaw Pittman LLP

(57) ABSTRACT

An imaging member containing a substrate, and an outer layer containing solid and liquid lubricants, and an image forming apparatus for forming images on a recording medium including the imaging member above, a development component to apply a developer material to said charge-retentive surface to develop said electrostatic latent image to form a developed image on said charge-retentive surface; a transfer component for transferring said developed image from said charge-retentive surface to another member or a copy substrate; and a fusing member to fuse said developed image to said copy substrate.

38 Claims, 3 Drawing Sheets

PHOTORECEPTOR LAYER HAVING SOLID AND LIQUID LUBRICANTS

CROSS REFERENCE TO RELATED APPLICATIONS

Reference is made to copending, commonly assigned U.S. patent application Ser. No. 11/126,664, filed May 11, 2005, entitled, "Photoconductive Members;" U.S. patent application Ser. No. 11/193,242, filed Jul. 28, 2005, entitled, "Polytetrafluoroethylene-doped Photoreceptor Layer having Polyol Ester Lubricants;" U.S. patent application Ser. No. 11/193,672, filed Jul. 28, 2005, entitled, "Photoreceptor Layer having Polyphenyl Ether Lubricant;" U.S. patent application Ser. No. 11/193,241, filed Jul. 28, 2005, entitled, "Photoreceptor Layer having Dialkyldithiophosphate Lubricant;" U.S. patent application Ser. No. 11/193,129, filed Jul. 28, 2005, entitled, "Photoreceptor Layer having Phosphate-based Lubricant;" and U.S. patent application Ser. No. 11/193,754, filed Jul. 28, 2005, entitled, "Photoreceptor Layer having Antioxidant Lubricant Additives." The disclosures of these applications are hereby incorporated by reference in their entirety.

BACKGROUND

This disclosure is generally directed to imaging members, photoreceptors, photoconductors, and the like. More specifically, the present disclosure is directed to a multi-layered photoreceptor with a substrate, an outer layer such as a charge transport layer or overcoat layer, an optional hole blocking, and/or optional undercoat layer, and wherein at least one layer comprises a combination of solid and liquid lubricants. The photoreceptors herein, in embodiments, have improved wear resistance, extended life, and excellent wear resistant characteristics. In addition, in embodiments, the present photoreceptors have improved toner cleanability.

Currently, the wear resistance of polytetrafluoroethylene-doped (PTFE-doped) charge transport layers (CTL) has been shown to be ineffective. Use of the liquid lubricant in combination with a solid lubricant has shown up to a 15 percent improvement in wear resistance when compared to a PTFE-doped CTL without the additional lubricant. The combination of solid and liquid lubricant has been shown to exhibit little or no detrimental effects to electrical and cyclic properties at all zones with a consistent wear improvement of about 10-20 percent as compared to known PTFE-doped CTL. In fact, the combination of solid and liquid lubricant has shown, in embodiments, excellent cycling and environmental stability. The liquid and solid lubricants can function well in many of the layers of the photoreceptor, such as the charge transport layer, overcoat layer, or other layer.

SUMMARY

Embodiments include an imaging member comprising a substrate; and thereover an outer layer comprising a combination of a solid and liquid lubricant.

Also, embodiments include an imaging member comprising a substrate; and thereover a charge transport layer comprising a solid and liquid lubricant.

In addition, embodiments also include an image forming apparatus for forming images on a recording medium comprising a) an imaging member comprising a substrate; and thereover an outer layer comprising a combination of solid and liquid lubricant; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

BRIEF DESCRIPTION OF THE DRAWINGS

For a better understanding, reference may be had to the accompanying figures.

DETAILED DESCRIPTION

Figure 1:
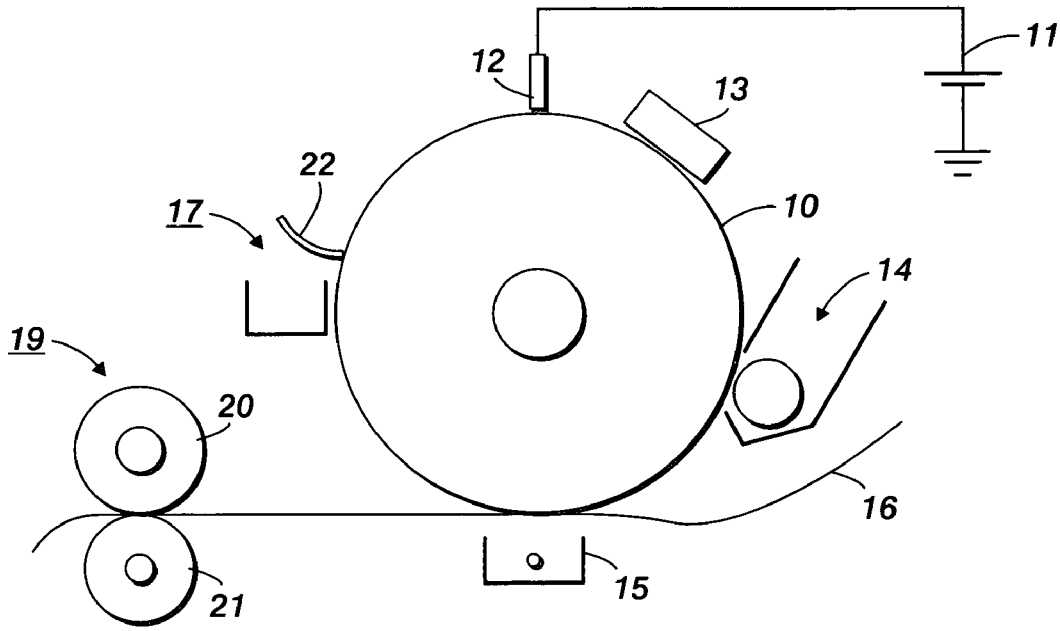
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned there from by use of a blade 22 (as shown in FIG. 1), brush, or other cleaning apparatus.

Figure 2:
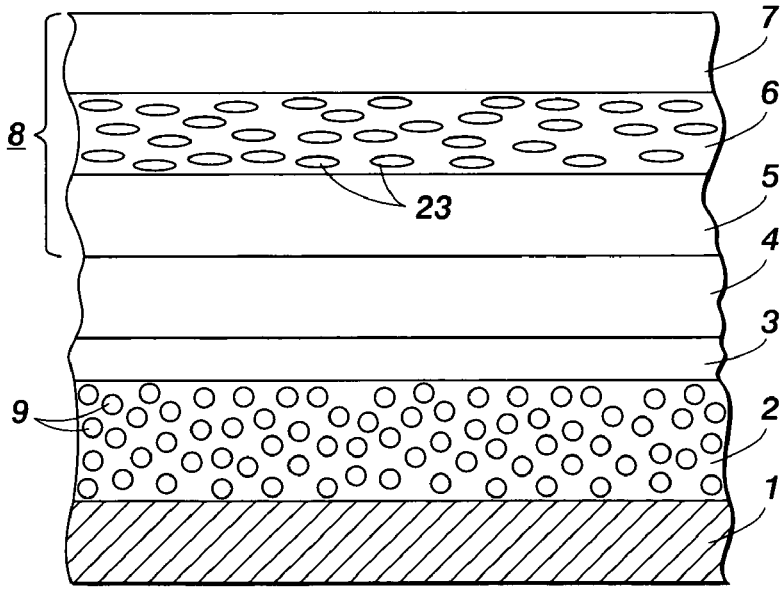
FIG. 2 is an illustration of an embodiment of a photoreceptor showing various layers and embodiments of filler dispersion.
Figure 3:
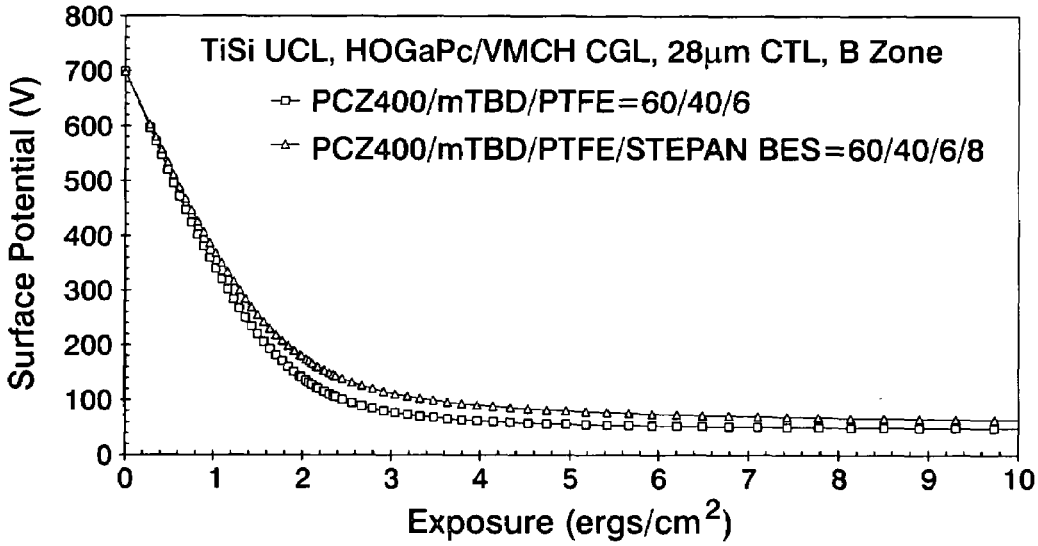
FIG. 3 is a graph showing surface potential versus exposure by use of an embodiment of the photoreceptor illustrated herein including an outer layer having PTFE and polyol ester.
Figure 4:
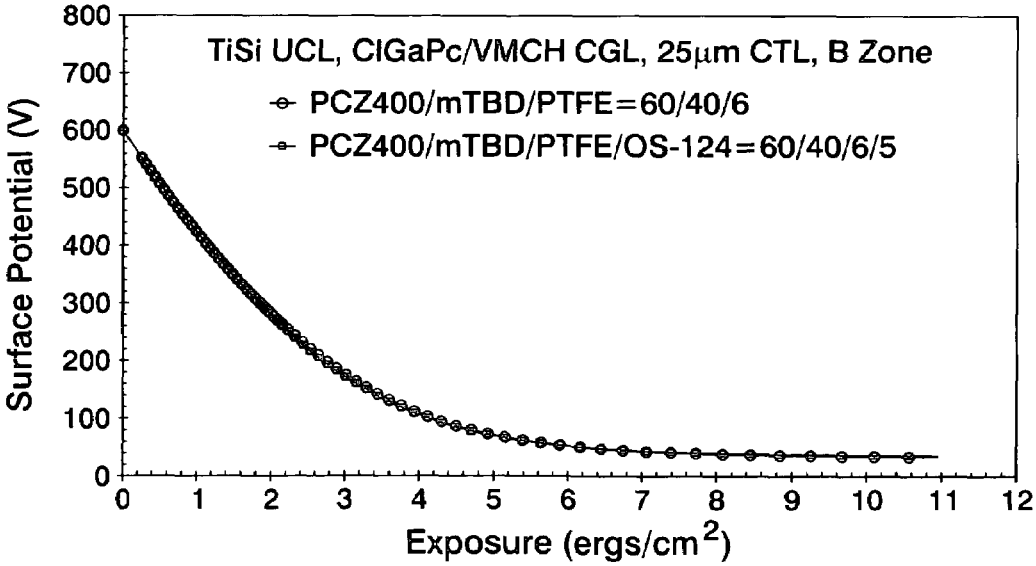
FIG. 4 is a graph showing surface potential versus exposure by use of an embodiment of the photoreceptor illustrated herein including PTFE and polyphenyl ether.
Figure 5:
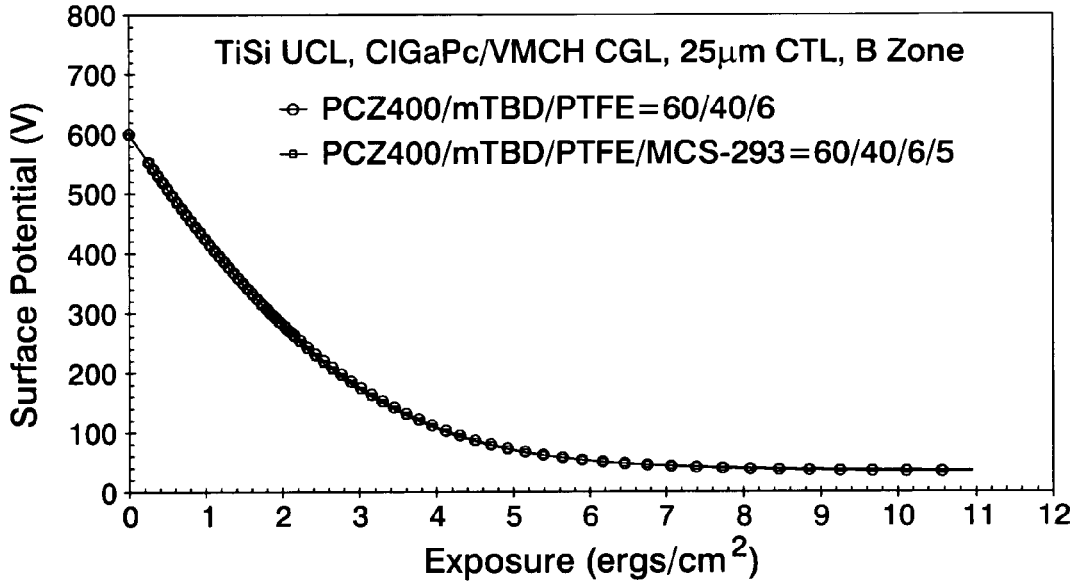
FIG. 5 is a graph showing surface potential versus exposure by use of an embodiment of a photoreceptor illustrated herein including PTFE and polyphenyl thioether.
Figure 6:
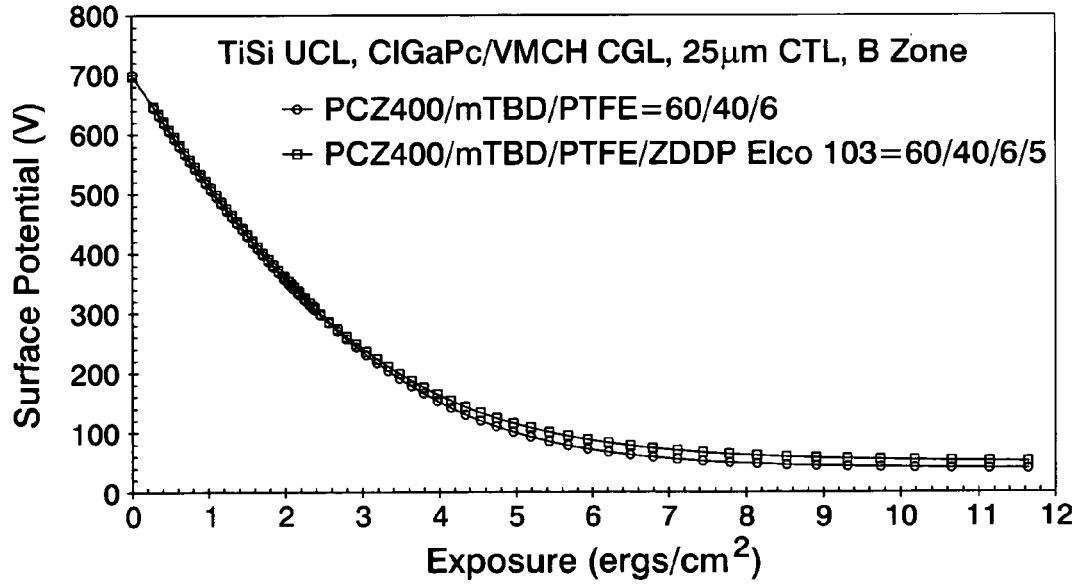
FIG. 6 is a graph showing surface potential versus exposure by use of an embodiment of a photoreceptor illustrated herein including PTFE and dialkyldithiophosphate.

Electrophotographic imaging members are well known in the art. Electrophotographic imaging members may be prepared by any suitable technique. Referring to FIG. 2, typically, a flexible or rigid substrate 1 is provided with an electrically conductive surface or coating 2.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. In embodiments, coating 2 is an electron transport layer discussed in detail below.

An optional hole-blocking layer 3 may be applied to the substrate 1 or coatings. Any suitable and conventional blocking layer capable of forming an electronic barrier to holes between the adjacent photoconductive layer 8 (or electrophotographic imaging layer 8) and the underlying conductive surface 2 of substrate 1 may be used. In embodiments, layer 3 is an interfacial layer discussed in detail below.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air-drying and the like.

At least one electrophotographic-imaging layer 8 is formed on the adhesive layer 4, blocking layer or interfacial layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5 and charge transport layer 6 and overcoat 7.

The charge-generating layer 5 can be applied to the electrically conductive surface, or on other surfaces in between the substrate 1 and charge-generating layer 5. A charge-blocking layer or hole-blocking layer 3 may optionally be applied to the electrically conductive surface prior to the application of a charge-generating layer 5. If desired, an adhesive layer 4 may be used between the charge blocking or hole-blocking layer or interfacial layer 3 and the charge-generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly (vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly (vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly (vinyl carbazole), and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent-coated layer may be effected by any suitable conventional technique such as oven drying, infrared radiation drying, air-drying and the like.

The charge transport layer 6 may comprise a charge transporting small molecule 23 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

In embodiments, the charge transport layer comprises PTFE. PTFE is present in the charge transport layer in an amount of from about 1 to about 20 percent, or from about 4 to about 10 percent. PTFE particle in CTL possesses a diameter of from about 50 nanometers to about 20 micrometers, or from about 200 nanometers to about 5 micrometers, or from about 500 nanometers to about 2 micrometers. PTFE particle in CTL can be primary PTFE particle or aggregated PTFE particle.

Any suitable electrically inactive resin binder insoluble in the alcohol solvent used to apply the overcoat layer 7 may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge-transporting polymer may also be used in the charge-transporting layer of this invention. The charge-transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The thickness of the continuous optional overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. In embodiments, the thickness is from about 1 micrometer and about 5 micrometers. Any suitable and conventional technique may be used to mix and thereafter apply the overcoat layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air-drying, and the like. The dried overcoating of this invention should transport holes during imaging and should not have too high a free carrier concentration. Free carrier concentration in the overcoat increases the dark decay. In embodiments, the dark decay of the overcoated layer should be about the same as that of the unovercoated device.

The overcoat layer can comprise same ingredients as charge transport layer, wherein the weight ratio between the charge transporting small molecule and the suitable electrically inactive resin binder and is smaller, and it could be as small as 0. The overcoat layer can comprise solid and liquid lubricants for extra wear resistance.

A combination of liquid and solid lubricants can be present in a photoreceptor layer. The outer layer can be any of the layers of the photoreceptor, such as, for example, the charge transport layer, overcoat layer, or other layer. The amount of liquid lubricant in the layer is, for example, from about 0.1 weight percent to 30 weight percent by the weight of the total solid contents, or from about 3 weight percent to about 20, or from 4 to about 10 weight percent based on the weight of the total solid contents of the layer. The amount of solid lubricant in the layer is, for example, from about 0.1 weight percent to 30 weight percent by the weight of the total solid contents, or from about 3 weight percent to about 20, or from 4 to about 10 weight percent based on the weight of the total solid contents of the layer. The total amount of liquid and solid lubricant in the layer is, for example, from about 0.1 weight percent to 30 weight percent by the weight of the total solid contents, or from about 3 weight percent to about 20, or from 4 to about 10 weight percent based on the weight of the total solid contents of the layer.

In embodiments, the ratio in weight percentage of the binder, optional charge transport component (in the case of a charge transport layer), the combination of solid and liquid lubricant in the layer is from about 50/20/30 to about 49.5/49.5/1. The weight ratio of solid versus the liquid in the combination of solid and liquid lubricant is from about 20/1 to about 1/20, or from about 5/1 to about 1/5.

A liquid lubricant is a lubricant that is in its liquid form under 20° C. and 1 atmosphere. Examples of suitable liquid lubricants include synthetic hydrocarbons; polyalphaolefins (PAO); sulfurized polyolefins; silahydrocarbons (SiHC); mineral oils; polyol esters; silicones; polyphenyl thioethers; polyphenyl ethers; C-ethers; thiophenyl disiloxanes; perfluoropolyethers; fluoroether triazines; dialkyldithiophosphates; dialkyldithiocarbamates; sulfur-based additives such as alkyl/aryl sulfides; phosphorous-based additives such as alkyl/aryl phosphates, alkyl/aryl acid phosphates, alkyl/aryl phosphates, alkyl/aryl hydrogenphosphites, acid phosphoric ester amine salts, and the like.

A number of lubricants can be selected for the photoreceptor layer. In embodiments, polyol esters can, for example, be used, and can be an ester generated from the reaction of a polyol containing one or more hydroxyl groups in one molecule with one or plural monobasic acids or acid halides. Suitable polyol examples may be selected from saturated and unsaturated straight and branched chain linear aliphatic; saturated and unsaturated cyclic aliphatics, including heterocyclic aliphatic; or mononuclear or polynuclear aromatics, including heterocyclic aromatics alcohols. Polyols with one hydroxyl group include methanol, ethanol, 1-propanol, 2-propanol, 1-butanol, 2-butanol, ethoxy ethanol, propoxy ethanol, butoxy ethanol, ethoxy propanol, propoxy propanol, butoxy propanol, ethoxy butanol, propoxy butanol, and butoxy butanol. Polyols with two or more hydroxyl groups include hindered alcohols with for example, from about 5 to about 30 carbon atoms, for example, neopentyl glycol, 2,2-diethyl propane-1,3-diol, 2,2-dibutyl propane-1,3-diol, 2-methyl-2-propyl propane-1,3-diol, 2-ethyl-2-butyl propane-1,3-diol, trimethylol ethane, trimethylol propane, ditrimethylol propane, tritrimethylol propane, tetratrimethylol propane, pentaerythritol, dipentaerythritol, tripentaerythritol, tetrapentaerythritol, and pentapentaerythritol, or mixtures thereof. Specific hindered alcohols are those with from about 5 to about 10 carbon atoms such as trimethylol propane, ditrimethylol propane, pentaerythritol, dipentaerythritol, and tripentaerythritol. Polyols also include carbohydrate molecules, such as monosaccharides including, for example, mannose, galactose, arabinose, xylose, ribose, apiose, rhamnose, psicose, fructose, sorbose, tagitose, ribulose, xylulose, and erythrulose. Oligosaccharides include, for example, maltose, kojibiose, nigerose, cellobiose, lactose, melibiose, gentiobiose, turanose, rutinose, trehalose, sucrose and raffinose. Polysaccharides include, for example, amylose, glycogen, cellulose, chitin, inulin, agarose, zylans, mannan and galactans. Although perhaps sugar alcohols may not be considered carbohydrates, the naturally occurring sugar alcohols are very closely related to carbohydrates. Examples of sugar alcohols are sorbitol, mannitol and galactitol.

Examples of the monobasic acids include saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid; unsaturated aliphatic carboxylic acids, such as stearic acid, acrylic acid, propionic acid, crotonic acid and oleic acid; and cyclic carboxylic acids, such as benzoic acid, toluic acid, napthoic acid, cinnamic acid, cyclohexanecarboxylic acid, nicotinic acid, isonicotinic acid, 2-furoic acid, 1-pyrrolecarboxylic acid, monoethyl malonate and ethyl hydorgenphthalate. Suitable saturated fatty acids include, for example, capric, lauric, palmitic, stearic, behenic, isomyristic, isomargaric, myristic, caprylic, and anteisoarachadic. Suitable unsaturated fatty acids include, for example, maleic, linoleic, licanic, oleic, linolenic, and erydiogenic acids. Mixtures of fatty acids derived from soybean oil, palm oil, coconut oil, cottonseed and fatty hydrogenated rapeseed oil can also be selected. Examples of acid halides, such as acid chlorides, include the chlorides of the monobasic acids.

Examples of polyol esters also include a neopentyl glycol caprylate caprate mixed ester, a trimethylolpropane valerate heptanoate mixed ester, a trimethylolpropane decanoate octanoate mixed ester, trimethylolpropane nananoate, and a pentaerythritol heptanoate caprate mixed ester. Specifically, in embodiments a polyol ester with about 4 or less, including no hydroxyl groups, can be selected.

Moreover, polyol esters, and/or dibasic acid esters can be incorporated into a layer of the imaging member. Dibasic acid esters include an adipate, azelate, sebacate, 1,9-nonamethylene dicarboxylic acid ester and so on. A complex ester can also be selected. As an alcohol for the dibasic acid ester, a linear or branched, a mono-or polyhydric aliphatic alcohol with, for example, from about 4 to about 20, or from about 8 to about 14 carbon atoms can be utilized. Examples of dibasic acid esters include dioctyl adipate, dioctyl sebacate, diisodecyl adipate, and didecyl adipate. As the organic ester, a polyol ester is selected.

Other examples include trimethylpropane tricaprylate (ZELEC™ 887, available from STEPAN Company, Northfield, Ill., USA); pentaerythrityl tetracaprylate (ZELEC™ 874 available from STEPAN Company, Northfield, Ill., USA); butoxy ethyl stearate (STEPAN BES available from STEPAN Company, Northfield, Ill., USA); and the like, and mixtures thereof.

Examples of these polyol esters are illustrated with reference to the following wherein R is as indicated herein, and more specifically, wherein R is an alkyl, such as an alkyl containing from about 1 to about 10 carbons, or from about 4 to about 6 carbons:

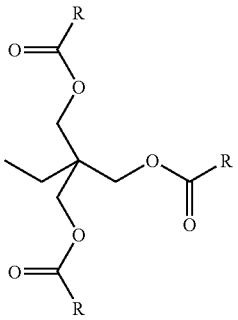

R = C7-C9 trimethylpropane tricaprylate

-continued

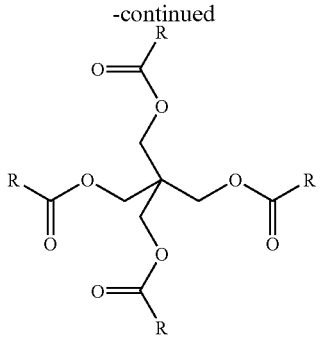

R = C7-C9 pentaerythrityl tetracaprylate zene (mmp-5P4E), p-bis(m-pohenoxyphenoxy)benzene (mpm-5P4E), 1-(m-phenoxyphenoxy)-4-(p-phenoxyphenoxy)benzene (mpp-5P4E), m-bis(p-phenoxyphenoxy)benzene (pmp-5P4E), p-bis(p-phenoxyphenoxy)benzene (ppp-5P4E), o-bis(m-phenoxyphenoxy)benzene (mom-5P4E), m-bis(o-phenoxyphenoxy)benzene (omo-5P4E), p-bis(o-phenoxyphenoxy)benzene (opo-5P4E), o-bis(o-phenoxyphenoxy)benzene (ooo-5P4E) and bis(phenoxyphenoxy) benzene isomer mixture (mix-5P4E) and bis (phenoxyphenoxyphenyl)ether isomer mixture (mix-6P5E), and the like. One or more of them, which are liquid in a normal state, are used.

In embodiments, liquid lubricants include polyphenyl thioethers, such as those with n+1 benzene rings linked by thioether bonds. For example, "n" in the n+1 benzene ring would be from about 1 to about 10, or from about 3 to about 6. The generic structure of polyphenyl thioether is:

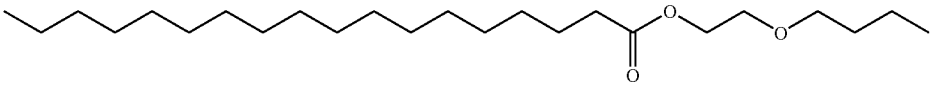

butoxy ethyl stearate

The polyol esters can be obtained from a number of sources. Also, these esters can be prepared by esterifying a polyol and an aliphatic acid in the presence or absence of an acidic catalyst and using dehydrating condensation; preparing the aliphatic acid chloride, which is then reacted with a polyol; or by an ester exchange reaction between an ester of a lower aliphatic alcohol and an aliphatic acid with a polyol. The mole ratio of hydroxyl to carboxylic acid or its equivalents, such as an acid chloride and acid ester, is, for example, about 1/1.

In embodiments, liquid lubricants include polyphenyl ethers, such as those with n+1 benzene rings linked by ether bonds. For example, "n" in the n+1 benzene ring would be from about 1 to about 10, or from about 3 to about 6. The generic structure of polyphenyl ether is:

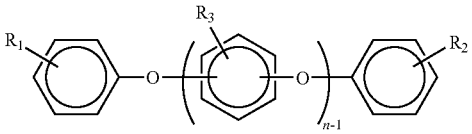

wherein $R_1$ $R_2$, and $R_3$ may be the same or different and are selected from H, or a straight or branched-chain alkyl having from about 1 to about 24 carbons, or from about 6 to about 20 carbons, or from about 8 to about 18 carbons. The hydrocarbon group may be bonded at any position of the aromatic ring.

Specific examples of polyphenyl ether include m-diphenoxybenzene (m-3P2E), bis(m-phenoxyphenyl)ether (mm-4P3E), m-phenoxyphenyl p-phenoxyphenyl ether (mp-4P3E), m-phenoxyphenyl o-phenoxyphenyl ether (mo-4P3E), bis(p-phenoxyphenyl)ether (pp-4P3E), p-phenoxyphenyl o-phenoxyphenyl ether (p,o-4P3E), bis(o-phenoxyphenyl ether (oo-4P3E), bis(phenoxyphenyl)ether isomer mixture (mix-4P3E), m-phenoxyphenoxy m-biphenyl (mm-4P2E), m-bis(m-phenoxyphenoxy)benzene (mmm-5P4E), 1-(m-phenoxyphenoxy)-3-(p-phenoxyphenoxy)ben-

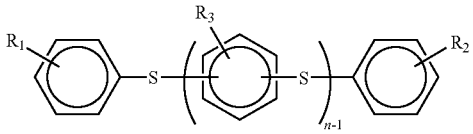

wherein $R_1$ $R_2$, and $R_3$ may be the same or different and are selected from H, or a straight or branched-chain alkyl having from about 1 to about 24 carbons, or from about 6 to about 20 carbons, or from about 8 to about 18 carbons. The hydrocarbon group may be bonded at any position of the aromatic ring.

Specific examples of polyphenyl ether include diphenyl thioether (2P1T), m-bis(phenylmercapto)benzene (m-3P2T), o-bis(phenylmercapto)benzene (o-3P2T), p-bis(phenylmercapto)benzene (p-3P2T), bis(phenylmercapto)benzene isomer mixture (mix-3P2T), bis(m-phenylmercaptophenyl)sulfide (mm-4P3T), bis(o-phenylmercaptophenyl)sulfide (oo-4P3T), bis(p-phenylmercaptophenyl)sulfide (pp-4P3T), m-phenylmercaptophenyl p-phenylmercaptophenyl sulfide (mp-4P3T), m-phenylmercaptophenyl o-phenylmercaptophenyl sulfide (mo-4P3T), p-phenylmercaptophenyl o-phenylmercaptophenyl sulfide (po-4P3T), bis(mix-phenylmercaptophenyl)sulfide isomer mixture (mix-4P3T), m-bis(m-phenylmercaptophenylmercapto)benzene (mmm-5P4T) 1-(m-phenylmercaptophenylmercapto)-3-(p-phenylmercaptophenylmercapto)benzene (mmp-5P4T), p-bis(m-phenylmecarcaptophenylmercapto)benzene (mpm-5P4T), 1-(m-phenylmercaptophenylmercapto)-4-(p-phenylmer captophenylmercapto)benzene (mpp-5P4T), m-bis(p-phenylmercaptophenylmercapto)benzene (pmp-5P4T), p-bis(p-phenylmercaptophenylmercapto)benzene (ppp-5P4T), o-bis(m-phenylmercaptophenylmercapto)benzene (mom5P4T), m-bis(o-phenylmercaptophenylmercapto)benzene (omo-5P4T), p-bis(o-phenylmercaptophenylmercapto)benzene (opo-5P4T), o-bis(o-phenylmercaptophenylmercapto)benzene (ooo-5P4T), mix-bis(phenylmercaptophenylmercapto) benzene isomer mixture (mix-5P4T) and the like.

Further, as specific examples of the polyphenyl thioether substituted with the hydrocarbon group, there can be mentioned mono-, di- or tri-alkylated polyphenyl thioether obtained by bonding from about 1 to about 3 alkyl groups of from about 6 to about 20 carbon atoms, or from about 10 to about 17 carbon atoms. For example, there can be mentioned monoalkylated m-bis(phenylmercapto)benzene (R1-m-3P2T), dialkylated m-bis(phenylmercapto)benzene (R2-m-3P2T), trialkylated m-bis(phenylmercapto)benzene (R3-m-3P2T), as well as an alkylation product of bis(m-phenylmercaptophenyl)sulfide, m-bis(m-phenylmercaptophenylmercapto)benzene and the like.

Among the compounds exemplified above, m-bis(phenylmercapto)benzene (m-3P2T), o-bis(phenylmercapto)benzene (o-3P2T), p-bis(phenylmercapto)benzene (p-3P2T), bis (m-phenylmercaptophenyl)sulfide (mm-4P3T) and m-bis(m-phenylmercaptophenylmercapto)benzene (mmm-5P4T) can be used.

In embodiments, liquid lubricants include C-ethers, such as those with n+m+1 benzene rings wherein n is from about 1 to about 9, m is from about 1 to about 9, n+m is from about 1 to about 10, or from about 3 to about 6, and linked by a combination of thioether and ether bonds. The generic structure of C-ether is:

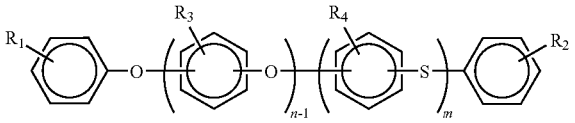

wherein $R_1$ $R_2$, $R_3$ and $R_4$ may be the same or different and are selected from H, or a straight or branched-chain alkyl having from about 1 to about 24 carbons, or from about 6 to about 20 carbons, or from about 8 to about 18 carbons.

More specific examples include those C-ether lubricants having the following formula:

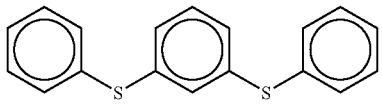

1,3-bis(phenylthio)benzene

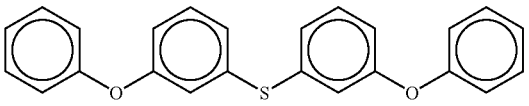

1,1-thiobis(3-phenoxybenzene)

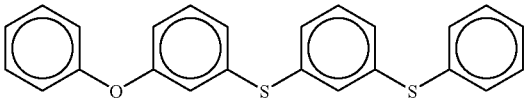

1-phenoxy-3-[[3-(phenylthio)phenyl]thio]benzene

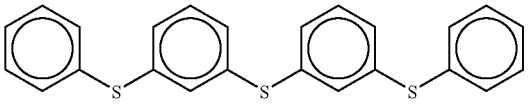

1,1-thiobis[3-(phenylthio)benzene]

In embodiments, liquid lubricants include dialkyldithiophosphates that can be either metal free or metal dialkyldithiophosphates, wherein metal includes zinc, molybdenum, lead, and antimony. The generic structures of metal dialkyldithiophosphates are:

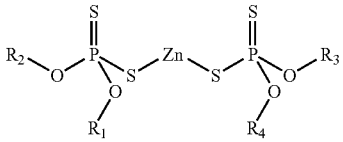

wherein $R_1$, $R_2$, $R_3$ and $R_4$ each independently represent a hydrogen atom, a $C_1$ to $C_{20}$ alkyl group, a $C_6$ to $C_{26}$ cycloalkyl, aryl, alkylaryl or arylalkyl group, or a $C_3$ to $C_{20}$ hydrocarbyl group containing an ester, ether, alcohol or carboxyl group; or a $C_2$ to $C_{18}$ alkyl group which may be straight-chain or branched, and

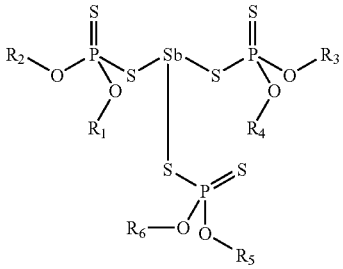

wherein $R_1$, $R_2$, $R_3$, $R_4$, $R_5$, and $R_6$, each independently represent a hydrogen atom, a $C_1$ to $C_{20}$ alkyl group, a $C_6$ to $C_{26}$ cycloalkyl, aryl, alkylaryl or arylalkyl group, or a $C_3$ to $C_{20}$ hydrocarbyl group containing an ester, ether, alcohol or-carboxyl group; or a $C_2$ to $C_{18}$ alkyl group which may be straight-chain or branched.

Specific examples of metal dialkyldithiophosphates include molybdenum di(2-ethylhexyl)dithiophosphate, zinc diethyldithiophosphate, and the like.

In embodiments, liquid lubricants include dialkyldithiocarbamates that can be either metal free or metal dialkyldithiocarbamates, wherein metal includes zinc, molybdenum, lead, and antimony. The generic structures of dialkyldithiocarbamates are:

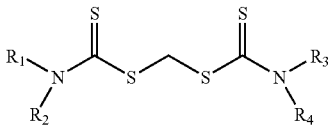

wherein $R_1$, $R_2$, $R_3$ and $R_4$ may be the same or different and are primary, secondary or branched alkyl chains having from about 1 to about 15 carbons, or from about 3 to about 8 carbons.

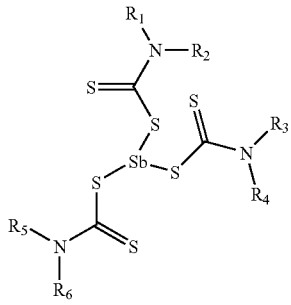

wherein $R_1$, $R_2$, $R_3$, $R_4$, $R_5$ and $R_6$ may be the same or different and are primary, secondary or branched alkyl chains having from about 1 to about 15 carbons, or from about 3 to about 8 carbons.

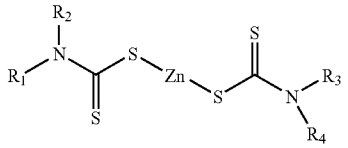

wherein $R_1$, $R_2$, $R_3$ and $R_4$ may be the same or different and are primary, secondary or branched alkyl chains having from about 1 to about 15 carbons, or from about 3 to about 8 carbons.

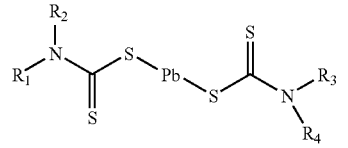

wherein $R_1$, $R_2$, $R_3$ and $R_4$ may be the same or different and are primary, secondary or branched alkyl chains having from about 1 to about 15 carbons, or from about 3 to about 8 carbons.

Specific examples of dialkyldithiocarbamates include methylene bis(dibutyldithiocarbamate), molybdenum di-n-butyldithiocarbamate, zinc diamyldithiocarbamate, lead diamyldithiocarbamate, and the like, and mixtures thereof.

In embodiments, liquid lubricants include phosphorous-based additives with a generic structure of:

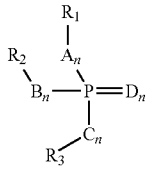

wherein $R_1$, $R_2$ and $R_3$ which may be identical or different with each other represent each a hydrogen atom or a hydrocarbon group of 1 to 18 carbon atoms, for example, linear or branched alkyl group of 1 to 13 carbon atoms, linear or branched alkenyl group of 2 to 13 carbon atoms, cycloalkyl group of 6 to 18 carbon atoms, and aryl group of 6 to 18 carbon atoms. The aryl group may have an alkyl group of 1 to 12 carbon atoms. A, B, C and D each represent an oxygen atom or a sulfur atom and n each is independently 0 or 1. The hydrocarbon group can be an alkyl group and an aryl group. As the alkyl group, those having from about 4 to about 10 carbon atoms can be used, and there can be exemplified, for example, butyl group, pentyl group, hexyl group, heptyl group and octyl group. Further, as the aryl group, there can be mentioned, for example, phenyl Croup, tolyl group, xylyl group and naphtyl group.

As the compound of the generic formula, there can be mentioned phosphate ester compounds, that is, normal phosphate, phosphite and partial esters thereof for example, triaryl phosphate, trialkyl phosphate, triaryl phosphorothionate, trialkyl phosphonate, triaryl phosphonate, trialkyl phosphinate, triaryl phosphinate, trialkyl phosphite and triaryl phosphite.

The phosphate ester having aryl group can be mentioned specifically, for example, triphenyl phosphate, tricresyl phosphate, benzyldiphenyl phosphate, ethyldiphenyl phosphate, cresyldiphenyl phosphate, dicresyl phenyl phosphate, ethylphenyldiphenyl phosphate, diethylphenylphenyl phosphate, propylphenyl diphenyl phosphate, dipropylphenylphynyl phosphate, triethylphenylphenyl phosphate, tripropylphenyl phosphate, butylphenyldipheny phosphate, dibutylphenylphenyl phosphate, tributylphenyl phosphate and propylphenyophenyl phosphate, and one or more of the compounds may be used, and the like.

In embodiments, liquid lubricants include alkyl or aryl acid phosphates. As the acid phosphate, a compound represented by the generic formula in which one or two of R1, R2 and R3 is a hydrogen atom can be used. Specific examples of these acid phosphates include dibutyl acid phosphate, dihexyl acid phosphate, di-2-ethylhexyl acid phosphate, didecyl acid phosphate, didodecyl acid phosphate (dilauryl acid phosphate), tridecyl acid phosphate, dioctadecyl acid phosphate (distearyl acid phosphate), di-9-octadecenyl acid phosphate (dioleyl acid phosphate), lauryl acid phosphate, and the like.

In embodiments, liquid lubricants include alkyl or aryl phosphites. Specific examples of these phosphites include trioleyl phosphite, and the like.

In embodiments, liquid lubricants include alkyl or aryl acid phosphites. Specific examples of these acid phosphites include dilauryl hydrogenphosphite, and the like.

In embodiments, liquid lubricants include phosphoric acid amine salts. The acidic phosphate amine salt is a reaction product of an acidic phosphate and an amine compound.

As the amine compound to be reacted with the acidic phosphate, there can be mentioned a primary or secondary amine having a hydrocarbon group of from about 6 to about 20 carbon atoms. As the hydrocarbon group, there can be mentioned, for example, a linear or branched alkyl group of from about 6 to about 20 carbon atoms: a linear or branched alkenyl group of from about 6 to about 20 carbon atoms; alkyl aryl group having an aryl group of from about 6 to about 20 carbon atoms and a linear or branched alkyl groups and arylalkyl group. Examples of acidic phosphate amine salts include a reaction product of methyl acid phosphate and a trialkyl amine of from about 10 to about 14 carbon atoms, a reaction product of butyl acid phosphate and dodecyl phenyl amine, a reaction product of butyl acid phosphate and an alkyl aromatic amine, a reaction product of hexyl acid phosphate and ditridecyl amine, a reaction product of octyl acid phosphate and oleylamine and a reaction product of an i-C8-C10 alkyl acid phosphate and oleyl amine. In addition to the acidic phosphate amine salt described above, acidic phosphite amine salt may also be used in combination. Specific examples of these phosphoric acid amine salts include lauryl acid phosphate diethylamine salt, isooctyl acid phosphate amine salt [a reaction product of (i-C8H17O)2P(OH)O and C16H33NH2], 2-ethylhexyl acid phosphate amine salt [a reaction product of (C8H17O)2P(O)OH+C8H17OP(O)(OH)2 and isotridecyl amine], and di-9-octadecenyl acid phosphate amine salt (dioleyl acid phosphate amine salt), and the like.

In embodiments, liquid lubricants include sulfur-based additives such as alkyl or aryl sulfides. The generic structure is:

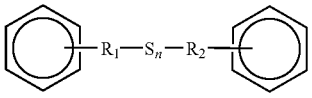

wherein $R_1$ and $R_2$ represent each a hydrocarbon group of 1 to 10 carbon atoms, or 1 to 5 carbon atoms. An alkylene group of from about 1 to about 2 carbon atoms can be used, and n is an integer of from about 1 to about 5, or from about 1 to about 3.

Specific examples of these sulfides include dibenzyl sulfide, distearyl sulfide, and the like. Sulfurized fats and oils and other paraffinic sulfide can be used together with or independent of the sulfur compound of the above generic formula.

A solid lubricant is a lubricant that is in its solid form under 20° C. and 1 atmosphere. Examples of suitable solid lubricants include fluorinated resins; lamellar solids such as dichalcogenides; hexagonal boron nitrite such as BN, white graphite, and the like; CdCl2, PbCl2, phthalocyanine, and the like; solids having low shearing strength such as Cd—, Co—, Zn-oxide, Bi— and Cd-sulfde, Ca—, Li— or Ba-fluoride, and the like; and polymeric resins such as polyethylene copolymers, oxidized polyethylene copolymers, polystyrene copolymers, micronized polyolefin wax, and the like; and mixtures thereof.

In embodiments, solid lubricants include fluorinated resins. Specific examples of these fluorinated resins include polytetrafluoroethylene (PTFE), and the like.

In embodiments, solid lubricants include dichalcogenides. Specific examples of these dichalcogenides include MoS2, WS2, WSe2, and the like.

In embodiments, solid lubricants include phthalocyanines. Specific examples of these phthalocyanines include metal-free phthalocyanine, titanyl phthalocyanine, copper phthalocyanine, magnesium phthalocyanine, and the like.

The dispersion was prepared either by subsequent mixing of the liquid lubricant with a previously made solid lubricant dispersion, or by first mixing of the liquid lubricant with a solution, then mixing of the resulting solution with a previously made solid lubricant dispersion, or by processing all ingredients together including solid and liquid lubricants using a CaviPro processor (Five Star technology, Cleveland, Ohio). In the embodiment wherein a polyphenyl ether and PTFE are used, in order to prevent additive shock to the PTFE dispersion, the liquid lubricant can be mixed with a small amount of a solution of poly(4,4'-dihydroxy-diphenyl-1-1-cyclohexane and N,N'-diphenyl-N,N-bis(3-methylphenyl)-1,1'-biphenyl-4,4'-diamine, such as a 60/40 mixture of these, and then mixed with the solid lubricant dispersion.

The following Examples are being submitted to illustrate embodiments of the present disclosure. These Examples are intended to be illustrative only and are not intended to limit the scope of the present disclosure. Also, parts and percentages are by weight unless otherwise indicated. Comparative Examples and data are also provided.

EXAMPLES

Example 1

Preparation of Photoreceptor

Six multilayered photoreceptors of the rigid drum design were fabricated by conventional coating technology with an aluminum drum of 34 millimeters in diameter as the substrate. These six drum photoreceptors contained the same undercoat layer (UCL). Among them, two of them (Device I and II) contained same hydroxygallium phthalocyanine (Type V) charge generating layer (CGL), and four of them (device III, IV, V and VI) contained same chlorogallium phthalocyanine (Type B) charge generating layer (CGL). Other differences are that two photoreceptor, Device I and III, contained a charge transport layer (CTL) comprising a film forming polymer binder, a charge transport compound and PTFE; Device II contained the same layers as Device I except that the polyol ester STEPAN BES (butoxy ethyl stearate, available from STEPAN Company, Northfield, Ill., USA) was incorporated into the charge transport layer. Device IV contained the same layers as Device III except that the polyphenyl ether Santovac OS-124 (five benzene rings linked by ether bonds with a pour point of 40° F. and a flash point of 550° F., available from Arch Technology Holding LLC, St. Charles, Mo., USA) was incorporated into the charge transport layer. Device V contained the same layers as Device III except that the polyphenyl thioether Santovac MCS-293 (four benzene rings linked by ether or thioether bonds with, a pour point of −29° C. and a flash point of 445° F, available from Arch Technology Holding LLC, St. Charles, Mo., USA) was incorporated into the charge transport layer. Device VI contained the same layers as Device III except that the zinc dialkyldithiophosphate Elco 103 (mixed, 2 primary and 1 secondary alcohols, C3-C5, available from Elco Corporation, Cleveland, Ohio, USA) was incorporated into the charge transport layer.

More specifically, a titanium oxide/phenolic resin dispersion was prepared by ball milling 15 grams of titanium dioxide (STR60N™, Sakai Company), 20 grams of the phenolic resin (VARCUM™ 29159, OxyChem Company, Mw of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 m2/gram with reference to the above $TiO_2$/Varcum™ dispersion. Additional solvents of 5 grams of 1-butanol, and 5 grams of xylene; 5.4 grams of the above prepared $SiO_2$/Varcum™ slurry were added to 50 grams of the above resulting titanium dioxide/Varcum™ dispersion, referred to as the coating dispersion. Then an aluminum drum, cleaned with detergent and rinsed with deionized water, was dip coated with the above generated coating dispersion at a pull rate of 160 millimeters/minute, and subsequently, dried at 145° C. for 45 minutes, which resulted in an undercoat layer (UCL) deposited on the aluminum and comprised of $TiO_2$/$SiO_2$/Varcum™ with a weight ratio of about 60/10/40 and a thickness of 4 microns.

A 0.5 micron thick photogenerating layer was subsequently coated on top of the above generated undercoat layer from a dispersion of Type V hydroxygallium phthalocyanine (3.0 grams) in Device I and II, or Type B chlorogallium phthalocyanine (3.0 grams) in Device III, IV, V and VI, and a vinyl chloride/vinyl acetate copolymer, VMCH (Mn=27,000, about 86 weight percent of vinyl chloride, about 13 weight percent of vinyl acetate and about 1 weight percent of maleic acid available from Dow Chemical (2 grams), in 95 grams of n-butyl acetate. Subsequently, a 25 μm thick charge transport layer (CTL) was coated on top of the photogenerating layer The CTL was dried at 120° C. for 40 minutes to provide the photoreceptor device. The preparation of the CTL dispersion was described as below.

Preparation of CTL dispersion for Device I and III: ALON GF-300, a polyfluoroacrylate derivative-graft-poly (methyl methacrylate) derivative copolymer available from Toagosei Chemical Industries, Tokyo, Japan (0.15 grams), was dissolved in 20 grams of tetrahydrofuran (THF) for 2 hours. Then POLYFLON PTFE L-2, available from Daikin Industries, Ltd., Osaka, Japan (7.5 grams), was added and mixed for 8 hours. The resulting PTFE slurry in THF was processed using a CaviPro-300 processor (Five Star technology, Cleveland, Ohio, USA) for 1 minute. The processed slurry was added to a solution prepared from N,N'-diphenyl-N,N-bis(3-methylphenyl)-1,1'-biphenyl-4,4'-diamine (50 grams) and a film forming polymer binder PCZ-400 [poly(4,4'-dihydroxy-diphenyl-1-1-cyclohexane, Mw=40,000)] available from Mitsubishi Gas Chemical Company, Ltd. (75 grams) dissolved in a solvent mixture of 200 grams of THF and 67 grams of toluene. The final dispersion was allowed to mix for 8 hours before coating.

Preparation of CTL dispersion for Device II: 10 grams of the polyol ester STEPAN BES (butoxy ethyl stearate, available from STEPAN Company, Northfield, Ill., USA) was added into the same CTL dispersion for Device I. The final dispersion was allowed to mix for 8 hours before coating.

Preparation of CTL dispersion for Device IV: 6.25 grams of the polyphenyl ether Santovac OS-124 (five benzene rings linked by ether bonds with a pour point of 40° F. and a flash point of 550° F., available from Arch Technology Holding LLC, St. Charles, Mo., USA) was added into the same CTL dispersion for Device III. The final dispersion was allowed to mix for 8 hours before coating.

Preparation of CTL dispersion for Device V: 6.25 grams of the polyphenyl thioether Santovac MCS-293 (four benzene rings linked by ether or thioether bonds with a pour point of −29° C. and a flash point of 445° F., available from Arch Technology Holding LLC, St. Charles, Mo., USA) was added into the same CTL dispersion for Device III. The final dispersion was allowed to mix for 8 hours before coating.

Preparation of CTL dispersion for Device VI: 6.25 grams of the zinc dialkyldithiophosphate Elco 103 (mixed, 2 primary and 1 secondary alcohols, C3-C5, available from Elco Corporation, Cleveland, Ohio, USA) was added into the same CTL dispersion for Device III. The final dispersion was allowed to mix for 8 hours before coating.

Example 2

Testing of Photoreceptors

The above prepared six photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Four photoinduced discharge characteristic (PIDC) curves were obtained from the two different pre-exposed surface potentials, and the data was interpolated into PIDC curves at an initial surface potential of 700 volts. Incorporation of polyol ester, polyphenyl ether, polyphenyl thioether or zinc dialkyldithiophosphate in PTFE-doped charge transport layer did not appear to adversely affect the electrical properties of the imaging members.

Example 3

Wear Resistance Testing

Wear resistance tests of the above six devices were performed using a FX469 (Fuji Xerox) wear fixture. The total thickness of each device was measured via Permascope before each wear test was initiated. Then the devices were separately placed into the wear fixture for 50 kcycles. The total thickness was measured again, and the difference in thickness was used to calculate wear rate (nm/kcycle) of the device. The smaller the wear rate the more wear resistant is the imaging member. The wear rate data were summarized as follows in Table 1 below.

TABLE 1

| Device | Wear Rate (nm/kcylce) |
|---|---|
| I | 50 ± 1 |
| II | 40 ± 1 |
| III | 50 ± 1 |
| IV | 38 ± 1 |
| V | 38 ± 1 |
| VI | 42 ± 1 |

Incorporation of polyol ester, polyphenyl ether, polyphenyl thioether or zinc dialkyldithiophosphate into PTFE-doped CTL improves wear resistance of the imaging member by about 10-20 percent when compared with that with PTFE-doped CTL.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging member comprising a) a substrate; and thereover b) a charge transport layer comprising charge transport molecules and a combination of solid lubricant in an amount of from about 4 to about 10 percent by weight of total solids in the charge transport layer and liquid lubricant in an amount of from about 4 to about 10 percent by weight of total solids in the charge transport layer, and wherein the solid and liquid lubricants are present in the charge transport layer in a ratio of from about 5/1 to about 1/5.

2. An imaging member in accordance with claim 1, wherein said liquid lubricant is selected from the group consisting of polyol esters; polyphenyl ethers; C-ethers; dialkyldithiophosphates; dialkyldithiocarbamates; phosphorous-based additives; sulfur-based additives; synthetic hydrocarbons; polyalphaolefins; sulfurized polyolefins;

silahydrocarbons; mineral oils; silicones; thiophenyl disiloxanes; perfluoropolyethers; fluoroether triazines; and mixtures thereof.

3. An imaging member in accordance with claim 2, wherein said polyol ester is selected from the group consisting of trimethylpropane tricaprylate, pentaerythrityl tetracaprylate, neopentyl glycol caprylate caprate mixed ester, trimethylolpropane valerate heptanoate mixed ester, trimethylolpropane decanoate octanoate mixed ester, trimethylolpropane nananoate, pentaerythritol heptanoate caprate mixed ester, butoxy ethyl stearate, and mixtures thereof.

4. An imaging member in accordance with claim 3, wherein said polyol ester is selected from the group consisting of trimethylpropane tricaprylate, pentaerythrityl tetracaprylate, butoxy ethyl stearate, and mixtures thereof.

5. An imaging member in accordance with claim 2, wherein said polyphenyl ether comprises n+1 benzene rings linked by ether bonds with the formula of:

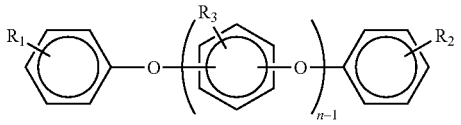

wherein $R_1$ $R_2$, and $R_3$ may be the same or different and are selected from the group consisting of hydrogen and an alkyl having from about 1 to about 24 carbons, and n is from about 1 to about 10.

6. An imaging member in accordance with claim 5, wherein said polyphenyl ether is selected from the group consisting of m-diphenoxybenzene, bis(m-phenoxyphenyl) ether, m-phenoxyphenyl p-phenoxyphenyl ether, m-phenoxyphenyl o-phenoxyphenyl ether, bis(p-phenoxyphenyl)ether, p-phenoxyphenyl o-phenoxyphenyl ether, bis(o-phenoxyphenyl ether, bis(phenoxyphenyl)ether isomer mixture, m-phenoxyphenoxy m-biphenyl, m-bis(m-phenoxyphenoxy)benzene, 1-(m-phenoxyphenoxy)-3-(p-phenoxyphenoxy)benzene, p-bis(m-phenoxyphenoxy)benzene, 1-(m-phenoxyphenoxy)-4-(p-phenoxyphenoxy)benzene, m-bis(p-phenoxyphenoxy)benzene, p-bis(p-phenoxyphenoxy) benzene, o-bis(m-phenoxyphenoxy)benzene, m-bis(o-phenoxyphenoxy)benzene, p-bis(o-phenoxyphenoxy) benzene, o-bis(o-phenoxyphenoxy)benzene, bis (phenoxyphenoxy)benzene isomer mixture, bis (phenoxyphenoxyphenyl)ether isomer mixture, and mixtures thereof.

7. An imaging member in accordance with claim 2, wherein said polyphenyl either is a polyphenyl thioether comprising n+1 benzene rings linked by thioether bonds with the formula of:

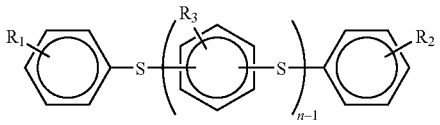

wherein $R_1$ $R_2$, and $R_3$ may be the same or different and are selected from the group consisting of hydrogen and an alkyl having from about 1 to about 24 carbons, and n is from about 1 to about 10.

8. An imaging member in accordance with claim 7, wherein said polyphenyl thioether is selected from the group consisting of m-bis(phenylmercapto)benzene, o-bis(phenylmercapto)benzene, p-bis(phenylmercapto)benzene, bis (m-phenylmercaptophenyl)sulfide and m-bis(m-phenylmercaptophenylmercapto)benzene, and mixtures thereof.

9. An imaging member in accordance with claim 2, wherein said C-ether has the formula:

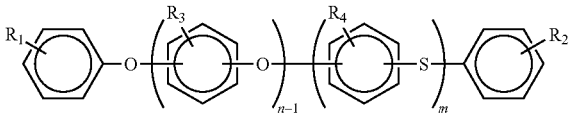

wherein $R_1$ $R_2$, $R_3$ and $R_4$ may be the same or different and are selected from the group consisting of hydrogen and an alkyl having from about 1 to about 24 carbons, and n+m is from about 1 to about 10.

10. An imaging member in accordance with claim 9, wherein said C-ether comprises n+m+1 benzene rings linked by a bond from a combination of ether and thioether bonds.

11. An imaging member in accordance with claim 9, wherein said C-ether is selected from the group consisting of 1, 3-bis(phenylthio)benzene; 1, 1-thiobis(3-phenoxybenzene); 1-phenoxy-3-[[3-(phenylthio)phenyl]thio] benzene; 1, 1-thiobis[3-(phenylthio)benzene; and mixtures thereof.

12. An imaging member in accordance with claim 2, wherein said dialkyldithiophosphate is selected from the group consisting of metal-free dialkyldithiophosphate and metal dialkyldithiophosphate.

13. An imaging member in accordance with claim 12, wherein said dialkyldithiophosphate is a metal dialkyldithiophosphate and said metal is selected from the group consisting of zinc, molybdenum, lead, and antimony.

14. An imaging member in accordance with claim 13, wherein said metal dialkyldithiophosphate is zinc dialkyldithiophosphate having a formula:

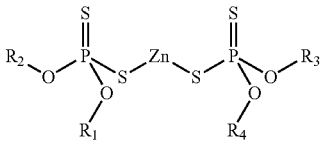

wherein $R_1$, $R_2$, $R_3$ and $R_4$ each are independently selected from the group consisting of a hydrogen atom, $C_1$ to $C_{20}$ alkyl group, $C_6$ to $C_{26}$ cycloalkyl group, $C_6$ to $C_{26}$ aryl group, $C_6$ to $C_{26}$ alkylaryl, $C_6$ to $C_{26}$ arylalkyl group, and $C_3$ to $C_{20}$ hydrocarbyl group.

15. An imaging member in accordance with claim 13, wherein said metal dialkyldithiophosphate is antimony dialkyldithiophosphate having a formula of:

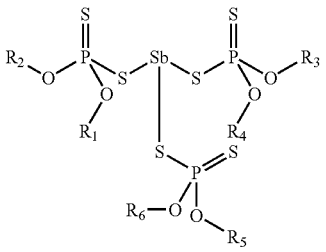

wherein $R_1$, $R_2$, $R_3$,$R_4$, $R_5$, and $R_6$ each independently are selected from the group consisting of hydrogen atom, $C_1$ to $C_{20}$ alkyl group, a $C_6$ to $C_{26}$ cycloalkyl, $C_6$ to $C_{26}$ aryl, $C_6$ to $C_{26}$ alkylaryl, $C_6$ to $C_{26}$ arylalkyl group, and a $C_3$ to $C_{20}$ hydrocarbyl group.

16. An imaging member in accordance with claim 2, wherein said dialkyldithiocarbamate is selected from the group consisting of metal-free dialkyldithiocarbamate and metal dialkyldithiocarbamate.

17. An imaging member in accordance with claim 16, wherein said dialkyldithiocarbamate is metal dialkyldithiocarbamate, and wherein said metal is selected from the group consisting of zinc, molybdenum, lead, and antimony.

18. An imaging member in accordance with claim 16, wherein said metal-free dialkyldithiocarbamate is methylene bis(dialkyldithiocarbamate) with a formula of:

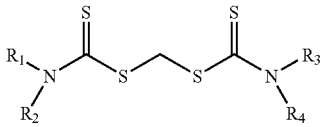

wherein $R_1$, $R_2$, $R_3$ and $R_4$ may be the same or different and are alkyl chains having from about 1 to about 15 carbons.

19. An imaging member in accordance with claim 16, wherein said metal dialkyldithiocarbamate is antimony dialkyldithiocarbamate with a formula of:

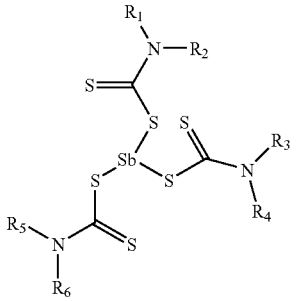

wherein $R_1$, $R_2$, $R_3$, $R_4$, $R_5$ and $R_6$ may be the same or different and are alkyl chains having from about 1 to about 15 carbons.

20. An imaging member in accordance with claim 16, wherein said metal dialkyldithiocarbamate is zinc dialkyldithiocarbamate with a formula of:

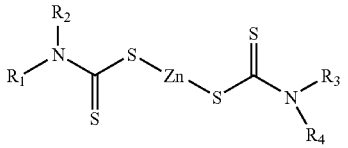

wherein $R_1$, $R_2$, $R_3$ and $R_4$ may be the same or different and are alkyl chains having from about 1 to about 15 carbons.

21. An imaging member in accordance with claim 16, wherein said metal dialkyldithiocarbamate is lead dialkyldithiocarbamate with a formula of:

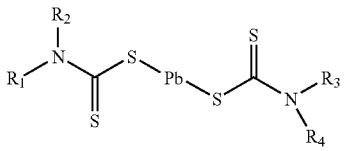

wherein $R_1$, $R_2$, $R_3$ and $R_4$ may be the same or different and are alkyl chains having from about 1 to about 15 carbons.

22. An imaging member in accordance with claim 2, wherein said phosphorous-based additive has the formula:

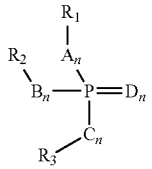

wherein $R_1$, $R_2$ and $R_3$ which may be the same or different with each represent a hydrogen atom or a hydrocarbon group having from about 1 to about 18 carbon atoms; A, B, C and D each represent an oxygen atom or a sulfur atom; and n is a number of from about 0 to about 1.

23. An imaging member in accordance with claim 22, wherein said phosphorous-based additive is selected from the group consisting of alkyl phosphate, aryl phosphate, alkyl phosphorothionate, aryl phosphorothionate, alkyl phosphonate, aryl phosphonate, alkyl phosphinate, aryl phosphinate, alkyl phosphite, aryl phosphite, alkyl acid phosphate, aryl acid phosphate, alkyl acid phosphite, aryl acid phosphite, amine salts of alkyl acid phosphate, aryl acid phosphate, alkyl acid phosphite, and aryl acid phosphite.

24. An imaging member in accordance with claim 23, wherein said phosphorus-based additive is selected from the group consisting of triphenyl phosphate, tricresyl phosphate, benzyldiphenyl phosphate, ethyldiphenyl phosphate, cresyldiphenyl phosphate, dicresyl phenyl phosphate, ethylphenyldiphenyl phosphate, diethylphenylphenyl phosphate, propylphenyl diphenyl phosphate, dipropylphenylphynyl phosphate, triethylphenylphenyl phosphate, tripropylphenyl phosphate, butylphenyldipheny phosphate, dibutylphenylphenyl phosphate, tributylphenyl phosphate and propylphenyophenyl phosphate, and mixtures thereof.

25. An imaging member in accordance with claim 23, wherein said phosphorus-based additive is selected from the group consisting of dibutyl acid phosphate, dihexyl acid phosphate, di-2-ethylhexyl acid phosphate, didecyl acid phosphate, didodecyl acid phosphate (dilauryl acid phosphate), tridecyl acid phosphate, dioctadecyl acid phosphate (distearyl acid phosphate), di-9-octadecenyl acid phosphate (dioleyl acid phosphate), lauryl acid phosphate, and mixtures thereof.

26. An imaging member in accordance with claim 23, wherein said phosphorus-based additive is an amine salt selected from the group consisting of lauryl acid phosphate diethylamine salt, isooctyl acid phosphate amine salt, 2-ethylhexyl acid phosphate amine salt, di-9-octadecenyl acid phosphate amine salt, and mixtures thereof.

27. An imaging member in accordance with claim 2, wherein said sulfur-based additive has the formula:

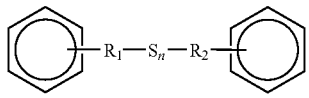

wherein $R_1$ and $R_2$ can be the same or different and each represent a hydrocarbon group of from about 1 to about 10 carbon atoms, and n is a number of from about 1 to about 5.

28. An imaging member in accordance with claim 27, wherein said sulfur-based additive is selected from the group consisting of dibenzyl sulfide, distearyl sulfide, and mixtures thereof.

29. An imaging member in accordance with claim 1, wherein said solid lubricant is selected from the group consisting of fluorinated resins, lamellar solids, hexagonal boron nitrite, $CdCl_2$, $PbCl_2$, phthalocyanine, CdO, CoO, ZnO, BiS CdS, $CaF_2$, LiF, $BaF_2$, polymeric resins, and mixtures thereof.

30. An imaging member in accordance with claim 29, wherein said solid lubricant is a fluorinated resin comprising polytetrafluoroethylene.

31. An imaging member in accordance with claim 29, wherein said solid lubricant is a lamellar solid selected from the group consisting of $MoS_2$, $WS_2$, $WSe_2$, and mixtures thereof.

32. An imaging member in accordance with claim 29, wherein said solid lubricant is a polymeric resin selected from the group consisting of polyethylene copolymers, oxidized polyethylene copolymers, polystyrene copolymers, micronized polyolefin wax, and mixtures thereof.

33. An imaging member in accordance with claim 1, wherein said charge transport layer further comprises a polycarbonate binder.

34. An imaging member comprising a) a substrate; and thereover b) a charge transport layer comprising solid and liquid lubricants, wherein the solid and liquid lubricants are present in the charge transport layer in a ratio of from about 5/1 to about 1/5, and thereover c) an outer layer.

35. An imaging member in accordance with claim 34, wherein said outer layer comprises solid and liquid lubricants.

36. An image forming apparatus for forming images on a recording medium comprising:

a) an imaging member comprising a substrate; and thereover a charge transport layer comprising charge transport molecules and a combination of solid lubricant in an amount of from about 4 to about 10 percent by weight of total solids in the charge transport layer and liquid lubricant in an amount of from about 4 to about 10 percent by weight of total solids in the charge transport layer, and wherein the solid and liquid lubricants are present in the charge transport layer in a ratio of from about 5/1 to about 1/5;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

37. An imaging member comprising a) a substrate; and thereover b) a charge transport layer comprising charge transport molecules and a combination of solid and liquid lubricants, wherein i) said solid lubricant is present in an amount of from about 4 to about 10 percent by weight of total solids in the charge transport layer and is selected from the group consisting of fluorinated resins, lamellar solids, hexagonal boron nitrite, CdCl2, PbCl2, phthalocyanine, CdO, CoO, ZnO, BiS CdS, CaF2, LiF, BaF2, polymeric resins, and mixtures thereof; and wherein ii) said liquid lubricant is present in an amount of from about 4 to about 10 percent by weight of total solids in the charge transport layer and is selected from the group consisting of polyol esters; polyphenyl ethers; C-ethers; dialkyldithiophosphates; dialkyldithiocarbamates; phosphorous-based additives; sulfur-based additives; synthetic hydrocarbons; polyalphaolefins; sulfurized polyolefins; silahydrocarbons; mineral oils; silicones; thiophenyl disiloxanes; perfluoropolyethers; fluoroether triazines; and mixtures thereof, and wherein the solid and liquid lubricants are present in the charge transport layer in a ratio of from about 5/1 to about 1/5.

38. An imaging member in accordance with claim 37, wherein said solid lubricant is polytetrafluoroethylene and said liquid lubricant is selected from the group consisting of polyol esters, polyphenyl ether, polypheyl thioether and zinc dialkyldithiophosphate.

* * * * *